United States Patent [19]

Champion et al.

[11] Patent Number: 4,829,336

[45] Date of Patent: May 9, 1989

[54] TONER CONCENTRATION CONTROL METHOD AND APPARATUS

[75] Inventors: James R. Champion, Longmont; Darrel E. Sartin, Boulder, both of Colo.

[73] Assignee: International Business Machines Corporation, Armonk, N.Y.

[21] Appl. No.: 182,599

[22] Filed: Apr. 18, 1988

[51] Int. Cl.[4] ..... G03G 15/06

[52] U.S. Cl. ..... 355/246; 355/214; 118/689

[58] Field of Search ..... 355/14 D, 3 DD, 8, 14 R; 118/688-691

[56] References Cited

U.S. PATENT DOCUMENTS

| | | | |
|---|---|---|---|
| 4,178,095 | 12/1979 | Champion et al. | 355/14 R |
| 4,179,213 | 12/1979 | Queener | 355/14 R |
| 4,183,657 | 1/1980 | Ernst et al. | 355/14 R |
| 4,272,182 | 6/1981 | Abe et al. | 355/14 D |
| 4,279,498 | 7/1981 | Eda et al. | 355/14 D |
| 4,312,589 | 1/1982 | Brannan et al. | 355/14 CH |
| 4,341,461 | 7/1982 | Fantozzi | 355/14 D |
| 4,348,099 | 9/1982 | Fantozzi | 355/14 E |
| 4,377,338 | 3/1983 | Ernst | 355/14 D |
| 4,432,634 | 2/1984 | Tabuchi | 355/14 D |
| 4,466,731 | 8/1984 | Champion et al. | 355/14 D |
| 4,502,777 | 3/1985 | Okamoto et al. | 355/14 R |
| 4,522,481 | 6/1985 | Imai et al. | 355/3 DD |
| 4,533,234 | 8/1985 | Watai et al. | 355/14 D |
| 4,551,004 | 11/1985 | Paraskevopoulos | 355/3 DD |
| 4,551,005 | 11/1985 | Koichi | 355/14 D |
| 4,564,287 | 1/1986 | Suzuki et al. | 355/14 D |
| 4,572,654 | 2/1986 | Murai et al. | 355/14 D |
| 4,607,933 | 8/1986 | Haneda et al. | 355/14 D |
| 4,657,377 | 4/1987 | Takahashi | 355/14 D |
| 4,684,243 | 8/1987 | Minor | 355/14 D |
| 4,742,372 | 5/1988 | Takahashi | 355/14 D |
| 4,745,434 | 5/1988 | Shimomura et al. | 355/14 D |
| 4,785,331 | 11/1988 | Oka et al. | 355/14 D |

*Primary Examiner*—R. L. Moses

*Attorney, Agent, or Firm*—Charles E. Rohrer; Francis A. Sirr

[57] ABSTRACT

A patch sensing toner concentration control method and apparatus is provided in which the optical density of reproduction output can be changed without changing the quantity of toner that is deposited on the photoconductor's test patch area. The test patch area receives toner as the patch area passes through a developer station under the influence of a patch development electrical field or vector. Light that is reflected from a bare photoconductor area is compared to light that is reflected from a toned test patch area. The ratio of these two reflected light intensities is used to control the addition of toner to the developer station. Optical density of the reproduction output is changed by changing the toner concentration in the developer station. The toner concentration control method and apparatus of the invention is constructed and arranged to require a fixed or constant ratio of light reflection as an indication of proper toner concentration, independent of the absolute value of toner concentration. Toner concentration, and thereby optical density of reproduction output, is changed by changing the magnitude of the patch development vector, while maintaining the reproduction development vector constant.

10 Claims, 2 Drawing Sheets

TONER CONCENTRATION CONTROL METHOD AND APPARATUS

DESCRIPTION

FIELD OF THE INVENTION

This invention relates to the field of xerographic reproduction, and more specifically to a method and apparatus for adjusting and controlling toner concentration in the developer station of a xerographic reproduction device, to thereby control the optical density of reproduction output.

DOCUMENTS INCORPORATED BY REFERENCE

U.S. Pat. Nos. 4,178,095; 4,179,213; 4,183,657 and 4,466,731.

BACKGROUND OF THE INVENTION

Xerographic reproduction, be it charged area development (CAD) copier reproduction or discharged area development (DAD) printer reproduction, involves the application of toner to the latent image of a photoconductor as the photoconductor passes through a developer station. Toner within the developer station deposits on the photoconductor's latent image due to the electrical charge that is carried by the toner, and due to the electrostatic reproduction development field that exists between the photoconductor's latent image and the portion of the developer station on which a supply of toner is carried.

For example, in a copier, and some printers, the photoconductor may be initially charged to a relatively uniform, high magnitude, negative voltage. The charged photoconductor is then subjected to the influence of an imaging station, where the photoconductor is selectively discharged in only its image background area, thereby leaving a highly charged latent image on the photoconductor. The photoconductor is now transported through a developer station, such as a magnetic brush developer station. A magnetic brush developer station typically includes a rotating metal cylinder that carries a layer of positively charged toner powder and negatively charged magnetic carrier beads. This cylinder is typically connected to a source of development electrode reproduction bias voltage whose polarity, in this case, would be negative, and whose magnitude would be less negative than that of the photoconductor's latent image.

Within the teachings of the present invention, such a development electrode field may comprise an AC field, a DC field, or may include both AC and DC components.

As a result of this developing process, positive toner moves from within the developer station to deposit on the photoconductor's negative latent image. This action takes place under the influence of the negative reproduction development field that extends from the negative metal cylinder of the developer station to the more negative photoconductor latent image.

Optical density of the photoconductor's toned latent image, at a location downstream of the developer station, is dependent upon factors such as (1) the quantity of toner in the developer station (i.e., the toner concentration), and (2) the magnitude of the reproduction development field.

Since toner is consumed as reproductions are made, many schemes have been originated to automatically replenish the developer station's toner supply. One of these schemes is known in the art as a patch sensor system.

In this type of toner concentration sensor, the intensity of light that is reflected from a toned test patch is compared to a control or reference intensity value that represents an intensity indicative of proper toner concentration. When toner concentration is proper, these two values, i.e., the control value and the measured value, are generally equal. As toner is depleted during use of the reproduction device, the light reflected from the test patch area increases, and an error signal is provided to a toner dispensing mechanism, causing toner to be added to the developer station, thus bringing toner concentration back to the predefined control concentration.

A specific type of patch sensing toner concentration control apparatus provides that the signal representing actual toner concentration is generated by comparing (1) the light reflected from a bare photoconductor patch to (2) light that is reflected from the toned test patch. Generally, such a patch sensing toner concentration control apparatus compares the ratio of these two reflected light magnitudes to a control ratio, and determines if toner need be added to the developer station as a result of this comparison.

A patch sensing toner concentration control apparatus of this type is disclosed in U.S. Pat. Nos. 4,178,095, 4,179,213 and 4,183,657. Apparatus of this type is useful in the practice of the present invention, and these patents are hereby incorporated by reference.

A feature of the present invention provides a grey toned patch, such as is described in U.S. Pat. No. 4,466,731, also incorporated herein by reference.

Examples of prior attempts to control the optical density of reproduction output are: U.S. Pat. No. 4,432,634 provides for image density control by changing the voltage to which the photoconductor is charged, and maintains a control difference between this value and the reproduction bias voltage; U.S. Pat. No. 4,502,777 detects conditions that cause the characteristics of the photoconductor to vary, and utilizes the detected conditions to maintain photoconductor charge substantially constant; and U.S. Pat. No. 4,564,287 provides for measurement of the potential of a latent image, and the control of image forming conditions such as development bias voltage, photoconductor charge voltage and original exposure intensity as a result of this measurement.

Examples of prior patch sensing toner concentration control schemes are: U.S. Pat. No. 4,272,182 provides a patch sensor in which a predetermined, constant bias voltage is used to develop the patch area, and wherein variable bias voltage can be used while forming reproduction output in accordance with the desired density for the reproduction output; U.S. Pat. No. 4,279,498 provides a patch sensor wherein the operating condition of the sensor is compensated for as a function of changes in reproduction parameters, such as variation in charge potential, developing bias voltage and/or power supply voltage; U.S. Pat. No. 4,312,589 provides a patch sensor wherein photoconductor charging is controlled as a function of how long a non-use time period the reproduction device has experienced; U.S. Pat. Nos. 4,348,099 and 4,341,461 provide a patch sensing scheme having a precopy mode of operation that sets the initial development bias, and a subsequent copy mode of operation that step-adjusts development bias, to achieve the normal bias level, and thereafter controls toner dispensing to the developer station; U.S. Pat. No. 4,377,338 provides a patch sensor wherein a multi-shade test pattern is initially formed and reflectance values for this test pattern are stored in memory, with subsequent reflectance values being compared to these stored values in order to control parameters such as toner replenishment, illumination lamp energization levels, and bias voltage level; U.S. Pat. No. 4,522,481 provides a patch sensor wherein the bias voltage that is used when forming the patch is varied in accordance with a fatigue standard associated with the photoconductor; U.S. Pat. No. 4,533,234 provides for a comparison of the toner density on a patch area to a reference density, and operates to jointly control the addition of toner to a developer station and adjustment of the development bias at this station, in order to control the quality of reproduction output; U.S. Pat. No. 4,551,004 provides a patch sensor utilizing collimated light; U.S. Pat. No. 4,551,005 provides a constant size sensor pattern for both equal size and unequal size copying, this resulting in the same pattern cleaning load for each type of copying; and U.S. Pat. No. 4,572,654 provides a black optical mark and a white optical mark that are reflected onto the photoconductor to form two test patches whose toner density ratio is used to control the feeding of toner to a developer station.

The foregoing and other features and advantages of the invention will be apparent from the following more particular description of preferred embodiments of the invention, as illustrated in the accompanying drawing.

THE INVENTION

The present invention provides an improved patch sensing toner concentration control method and apparatus in a electrophotographic reproduction device. The invention provides an improved means for changing the optical density of reproduction output, without changing the cleaning load that is represented by the quantity of toner deposited on the photoconductor's test patch.

Exemplary reproduction devices in which the invention finds utility are charged area development (CAD) copiers/printers and discharged area development (DAD) printers. The invention will be described with particular reference to CAD devices. However those skilled in the art will recognize that the invention finds equal utility in DAD devices.

The invention provides a constant control, target, or reference toner density against which the actual toner density of a toned test patch is compared. One advantage of such an arrangement is that it provides a constant test patch cleaning load.

More specifically, light is reflected from the toned test patch, and the intensity of this reflected light is compared to a control intensity value. Toner is added to the device's developer station when it is found that the actual toner density is less than the control toner density, i.e., when it is found that more light is reflected from the toned test patch than is called for by the reflectance control value.

As is well known, the optical density of reproduction output sheets can be changed by changing the toner concentration in the developer station. For example, if blacker output is desired (assuming the use of black toner in the developer station), the concentration of toner in the developer station is increased.

In accordance with the invention, the concentration of toner in the developer station is changed by changing the magnitude of the development vector that is used to develop the photoconductor's test patch (herein called the patch development vector or field).

More specifically, if the optical density of the output sheets are to be increased, the magnitude of the patch development vector is decreased. As a result, less toner is placed on the test patch by operation of the developer station. The quantity of light reflected from the test patch now increases. The comparison of this higher magnitude reflected light to the constant control reflectance value causes toner to be added to the developer until the control reflectance value is in fact achieved.

In this way, toner concentration within the developer station is increased. However, the magnitude of the development vector that is used when making reproductions (herein called the reproduction development vector or field) is not changed. As a result, the output reproduction sheets are now produced with a higher toner concentration, but with the same reproduction development vector. The output reproductions are therefore of higher optical density.

Figure 1:
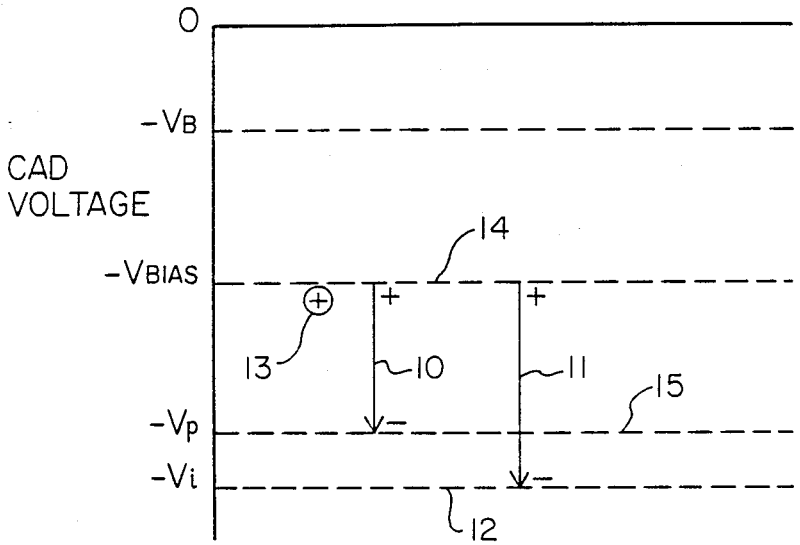
FIG. 1 is a vector representation of the electrostatic parameters of a charged area development reproduction device in accordance with the present invention.
Figure 2:
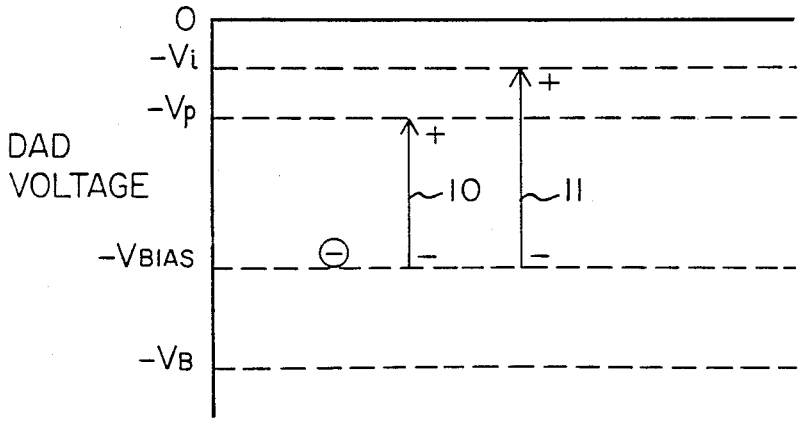
FIG. 2 is a vector representation of the electrostatic parameters of a discharged area development reproduction device in accordance with the present invention.

FIGS. 1 and 2 are useful in understanding the significance of the above-mentioned patch development and reproduction development vectors for CAD and DAD reproduction devices, respectively. These figures represent exemplary reproduction devices in which the photoconductor is initially charged to a negative voltage. The present invention however finds equal utility in devices that provide positive photoconductor charging. Only the CAD device whose electrostatic parameters are shown in FIG. 1 will be described in detail, however this description is readily extendable to the DAD device represented by FIG. 2.

Both the CAD and the DAD device include a patch sensing toner concentration control apparatus that operates to produce a grey test patch on the photoconductor (assuming the use of black toner). However, the present invention is not to be limited to these specific toner concentration control arrangements.

In both FIG. 1 and FIG. 2, reference numeral 10 designates the patch development vector, and numeral 11 designates the reproduction development vector.

FIG. 1 represents the electrostatic conditions for a CAD device, for example, a copier. In this device the photoconductor is initially charged to a high negative voltage, designated $-Vi$. After imaging an original document onto the photoconductor, the document's photoconductor latent image (the area that is to be toned or colored by black toner) remains charged to about the initial charge magnitude $-Vi$. The document's photoconductor background area is to be untoned, and this area has been substantially completely discharged, as is shown at $-Vb$.

The document's latent image is developed by positively charged toner particles, one particle of which is shown at 13. These toner particles reside in a developer station having a negative development electrode bias voltage 14, designated −Vbias, applied thereto.

As stated, the patch sensor for this CAD device is constructed and arranged to produce a grey-toned patch area from which light is reflected as a measure of the toner concentration in the developer station. Thus, the latent image of the test patch is formed so as to be of a lesser negative potential 15 (designated −Vp) than is the document's latent image −Vi.

As is apparent, two distinctly different development vectors 10 and 11 operate to tone these two photoconductor areas. Namely, the test patch area at voltage −Vp is toned to a grey shade, and the latent image area at voltage −Vi is toned black.

As is well known to those of skill in the art, the optical density of the toned test patch area −Vp and/or the toned latent image area −Vi of the photoconductor will vary as a direct function of the toner concentration in the developer station.

In accordance with a feature of the present invention, the magnitude of reproduction vector 11 is maintained substantially constant. When it is desired to change the optical density of reproduction output, the magnitude of patch vector 10 is changed, while the magnitude of reproduction vector 11 is not changed, or at least vector 11 is not changed for purposes of changing the optical density of reproduction output.

Although FIGS. 1 and 2 show the use of the same magnitude −Vbias to form patch development vector 10 and reproduction development vector 11, this is not critical to the invention. One means of implementing the present invention provides for changing the magnitude of patch development vector 10 by changing the −Vbias that is used for forming patch vector 10, without changing the −Vbias that is used during the production of reproduction output. In this embodiment of the invention, the −Vbias that is used to form the toned patch, and the −Vbias that is used during reproduction are usually of different magnitudes.

For example, assume that the operator desires "blacker" reproduction output, i.e., higher optical density output. In accordance with the invention, the magnitude of patch development vector 10 is decreased. As a result, less toner is deposited on the patch area, i.e., the patch becomes less grey. The toner concentration control apparatus of the invention accordingly generates an error signal that causes toner to be added to the developer station, i.e., the toner concentration is increased. As a result of this increased toner concentration, the greyness of the test patch area is restored to its target or control value. However, a higher toner concentration now resides in the developer station. Since the magnitude of the reproduction development vector 11 is not changed, the reproduction output is now produced with a higher optical density.

An important feature of the invention is that the photoconductor cleaning load represented by the quantity of toner particles resident on the test patch area has not increased, even though the toner concentration operating point of the reproduction device has increased. This is due to the fact that regardless of the toner concentration requested by the operator, the test patch is always toned to the same level of greyness in order to satisfy the requirements of the toner concentration control apparatus. This same level of greyness represents a constant quantity of toner to be removed by the reproduction device's cleaning station.

Other means of changing the magnitude of patch development vector 10, such as changing the voltage to which the photoconductor is charged during test patch cycles, will be recognized by those skilled in the art and are to be considered within the scope and content of this invention.

With reference to the CAD device exemplified by FIG. 1, the magnitude of patch development vector 10 can be changed (1) by changing the value of −Vbias that is used when developing the patch area, usually without changing the value of the reproduction development vector 11 that is used during the making of reproductions; (2) by changing the photoconductor's initial charge voltage −Vi, and/or by changing the manner in which the patch area is discharged from −Vi to a value −Vp, without changing the value of development vector 11; and/or (3) by changing the value of the patch voltage −Vp, for example, by changing the manner in which the photoconductor's patch area is discharged from the initial value of −Vi to a value −Vp, again without changing the value of reproduction vector 11.

With reference to the DAD device exemplified by FIG. 2, the magnitude of its patch development vector 10 can be changed (1) by changing the value of −Vbias that is used when developing the patch area, without changing the value of its reproduction development vector 11 that is used during the making of reproductions; (2) by changing the photoconductor's initial charge voltage −Vb, without changing the value of development vector 11; (3) by changing the manner in which the patch area is discharged from −Vb to −Vp, without changing the value of development vector 11; and/or (4) by changing the value of the patch voltage −Vp, for example, by changing the manner in which the photoconductor's patch area is discharged from the initial value of −Vb to −Vp.

Figure 3:
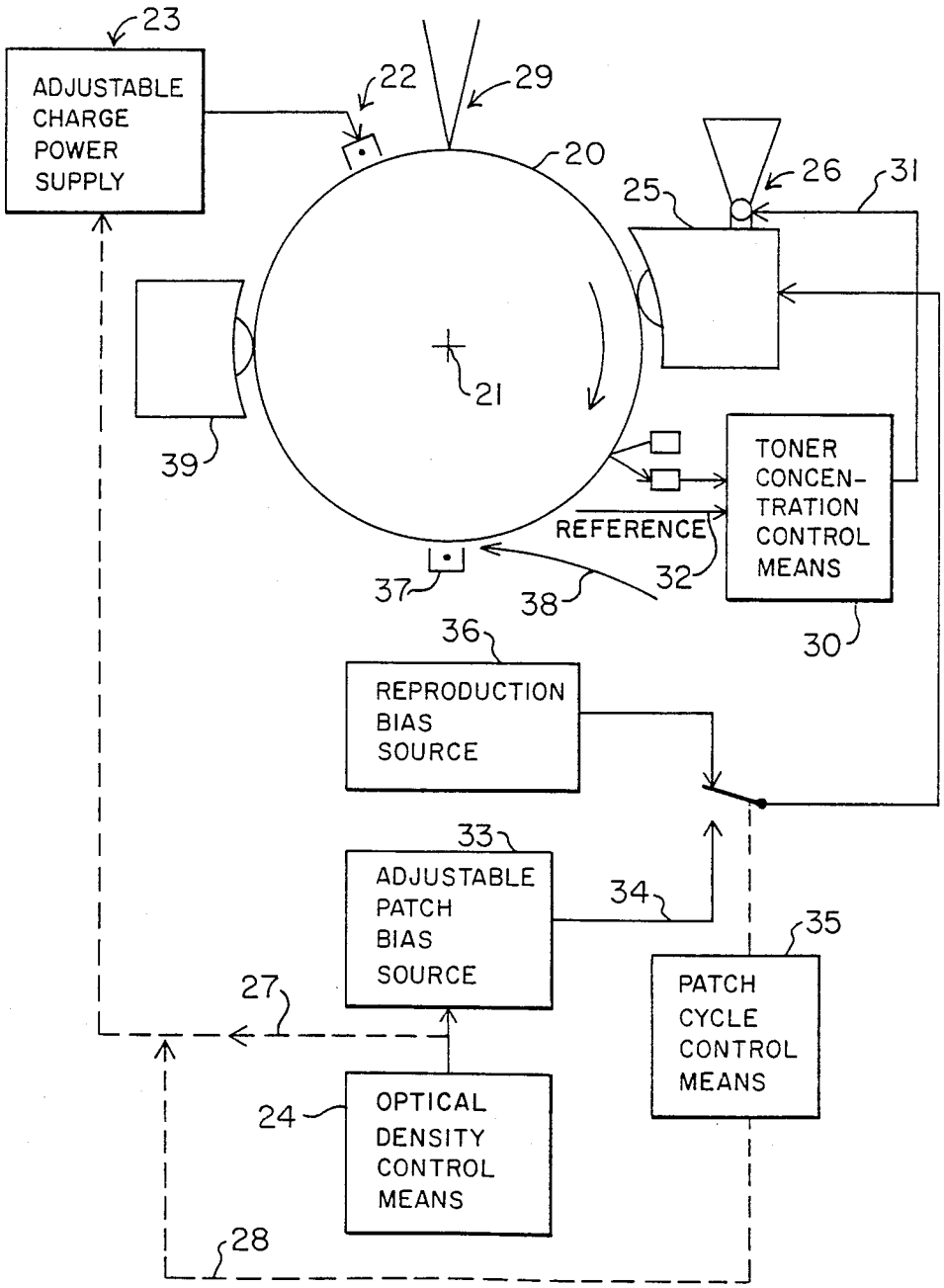
FIG. 3 is a schematic showing of a charged area development reproduction device in accordance with the present invention.

FIG. 3 discloses a CAD reproduction device in accordance with the invention. The device of FIG. 3 is a single cycle device having a cleaning station 39. However, the invention finds equal utility in a two cycle device where developer station 25 acts as a cleaning station as the photoconductor cycles through the developer station during a second cycle. CAD devices of this type are well known to those of skill in the art. Thus, the device of FIG. 3 will not be described in detail.

In this device, a reusable photoconductor 20, in drum form, rotates clockwise at substantially a constant velocity about axis 21. A number of electrophotographic or xerographic process stations are disposed about the periphery of drum 20 and cooperate therewith.

During a reproduction process or a patch sensing process, the photoconductor is first uniformly charged to a relatively high negative voltage, about equal to −Vi, by operation of charge corona 22. Corona 22 is connected to receive its operating voltage from power supply 23. A well known means for changing the voltage to which the photoconductor is charged operates to change the voltage applied to the grid (not shown) of corona 22.

During reproduction, an imaging station 29 operates to selectively discharge photoconductor 20 in the photoconductor areas that comprise the background (i.e., the white areas) of the image to be reproduced. Imaging station 29 operates to form a charged latent image, of about potential −Vi, in those areas of photoconductor 20 that are to be toned black as the photoconductor passes through magnetic brush developer station 25.

In accordance with the teachings of the above mentioned United States patents incorporated herein by reference, a patch sensing toner concentration control means 30 operates to provide a toner concentration error signal on conductor 31 during patch sensing cycles. This signal is applied to toner dispenser 26, to thereby add toner to developer station 25 whenever means 30 detects that the concentration of toner (i.e., the quantity of toner) in the developer station is low. For example, means 30 operates to compare the ratio of (1) the light reflected from a bare photoconductor patch, to (2) the light reflected from a grey toned photoconductor patch. This ratio signal is then compared to a steady state reference signal that is provided to means 30 by conductor 32.

In accordance with a feature of the invention, reference signal 32 is not changed when a change in the optical density of reproduction output is requested. Rather, the invention provides an optical density control means 24 that operates to change the magnitude of patch development vector 10, i.e., the development electrode bias that is used when the above-mentioned grey photoconductor patch is in the process of being developed by developer station 25.

More specifically, a density control means 24 is connected to an adjustable magnitude source of patch development electrode voltage 33. Output 34 of source 33 is periodically connected to developer station 25, to provide a development electrode voltage thereto, whenever the developer station is in the process of developing the above-mentioned grey patch. This function is controlled by patch cycle control means 35. As an example, cycle control means 35 operates, in conjunction with toner concentration control means 30, to test the toner concentration in developer station 25 once every 35 reproductions.

During the making of reproductions, reproduction bias source 36 is connected to developer station 25 to provide development electrode voltage thereto. In accordance with of the invention, the magnitude of source 36 is not changed as a result of a request that a change in optical density be provided.

When making reproductions, a major portion of the toned latent image is transferred to a substrate material, usually white paper, at transfer station 37, as the material moves along path 38. The substrate material then passes to a fusing station (not shown), and finally to a reproduction output device.

The photoconductor's latent image area then moves on to cleaning station 39, where the latent image's residual toner is cleaned from the photoconductor. The charge on the photoconductor is then removed, and the photoconductor is now ready for reuse.

During the formation of a toner test patch, the entire quantity of toner comprising the grey toned patch is cleaned from the photoconductor by operation of cleaning station 39. A feature of the invention is that this quantity of toner remains substantially constant, independent of a change in the optical density of reproduction output, i.e., independent of a change in the toner concentration in developer station 25.

While the embodiment of FIG. 3 shows detection of the grey toner patch on the surface of photoconductor 20, it is within the scope of the invention to transfer the major portion of this patch to substrate material by operation of transfer station 37, and to then sense the intensity of light that is reflected from the substrate's patch area, as a measure of the concentration of toner in developer station 25.

Operation of the device of FIG. 3 is as follows. When the operator desires to produce reproductions having a higher optical density, density control means is manually operated to increase the magnitude of patch bias source 33. As a result, the photoconductor's patch area is developed under the influence of a smaller magnitude patch development vector 10. The quantity of toner deposited on the grey patch area therefore decreases. This has the effect of generating a concentration-low signal on conductor 31. Toner is now added to developer station 25 until the level of greyness of the patch is restored to that required by reference signal 32. Reproductions are thereafter made using the same magnitude of reproduction development vector 11, but with a higher concentration of toner in developer station 25. As a result, the reproductions have a higher optical density. However, since the level of greyness of the patch has not changed (i.e., the level of greyness remains as required by reference signal 32), the patch cleaning load of cleaning station 39 remains substantially unchanged, as the reproduction optical density is changed.

In accordance with the above-described embodiment of the invention, optical density control means 24 operates to adjust the magnitude of power supply 33. Another embodiment controls power supply 23.

For example, when the optical density of reproduction output is to be increased, the negative output voltage of supply 23 is decreased in magnitude (alone or in conjunction with a change in power supply 33), but only during patch sensing cycles. In this way, patch development vector 10 decreases in magnitude. This reduction in the magnitude of vector 10 causes toner to be added to developer station 25 by way of toner dispenser 26, as above described. As a result, the toner concentration in developer station 25 increases, and the optical density of reproduction output, which output is formed using reproduction development vector 11, is therefore increased.

This alternate construction and arrangement of FIG. 3 is shown by dotted lines 27 and 28.

While the present invention has been shown and described with reference to preferred embodiments thereof, other embodiments will be apparent to those of skill in the art, and the scope and content of the invention is to be as is defined by the following claims.

We claim as our invention:

1. A patch sensor method for maintaining toner concentration in the developer station of an electrophotographic reproduction device having a photoconductor that is movable through said developer station, comprising:

providing means operable to establish a reproduction development vector between said photoconductor and said developer station during the formation of reproduction output;

providing means operable to establish a patch development vector between said photoconductor and said developer station during the formation of a test patch;

providing patch sensing means operable to sense the quantity of toner that is deposited on said test patch after said test patch is toned using said patch development vector;

comparing said sensed quantity of toner to a control quantity to thereby derive an error signal;

using said error signal to control the addition of toner to said developer station, to thereby control the concentration of toner therein; and providing optical density control means operable to change the concentration of toner within said developer station in order to change the optical density of reproduction that occurs while using said reproduction development vector;

said control means being operable to change the magnitude of said patch development vector, whereby said toner concentration, and thereby the optical density of said reproduction output, is changed without changing the quantity of toner that is deposited on said toned photoconductor test patch while using said patch development vector.

2. The method of claim 1 wherein said reproduction device includes a photoconductor cleaning station, and wherein said method maintains a substantially constant photoconductor test patch cleaning load for said cleaning station, independent of changes in said toner concentration.

3. The method of claim 2 wherein said patch sensing apparatus includes means to project light toward said toned test patch, and wherein the quantity of toner on said test patch is an inverse function of the intensity of light that is reflected from said test patch.

4. A patch sensor method for maintaining toner concentration in the developer station of a xerographic reproduction device having a photoconductor that is movable through said developer station, comprising:

providing means operable to establish a patch development vector between the photoconductor and said developer station;

providing patch sensing means operable to compare (1) the quantity of light that is reflected from an untoned photoconductor area to (2) the quantity of light that is reflected from a toned photoconductor patch area, where the ratio of said two reflected light quantities is a measure of the quantity of toner in said developer station;

comparing said ratio to a control ratio having a fixed value, to thereby derive an error signal;

using said error signal to control the addition of toner to said developer station, to thereby control the concentration of toner therein; and providing control means operable for selectively changing the concentration of toner within said developer station in order to change the optical density of reproduction output;

whereby said toner concentration, and the optical density of said reproduction output, is changed without changing the quantity of toner that is deposited on said toned photoconductor patch area.

5. The method of claim 4 wherein said reproduction device includes a photoconductor cleaning station, and wherein said method maintains a substantially constant toned photoconductor patch area cleaning load for said cleaning station, independent of changes in said toner concentration.

6. An electrophotographic reproduction device having a reusable photoconductor on which reproduction latent images are formed, said reproduction latent images subsequently being toned as said images pass through a developer station in the presence of a reproduction development field, the photoconductor's toned image subsequently being partially transferred to substrate material, to thereby form reproduction output, and in which said photoconductor is then cleaned of residual toned images in preparation for reuse of said photoconductor, comprising:

toner concentration control means operable to periodically produce a test latent image on said photoconductor, said test latent image being toned as said test latent image passes through said developer station in the presence of a test development field, said concentration control means including means responsive to the resulting quantity of toner deposited on said test latent image to control the addition of toner to said developer station as toner is depleted by the production of said reproduction output, said quantity of toner deposited on said test latent image being cleaned from said photoconductor by operation of said cleaning station; and means operable to adjust the toner concentration control point to be used when producing said reproduction output, said adjusting means being operable to change the magnitude of said test development field in order to effect said change in said toner concentration control point.

7. The reproduction device of claim 6 wherein said adjusting means operates to change the magnitude of said test development field as an inverse function of the desired change in toner concentration, and wherein the optical density of said reproduction output changes as a direct function of a change in toner concentration.

8. The reproduction device of claim 7 wherein said inverse relationship between a change in said test development field and the resulting change in toner concentration operates to produce a substantially constant quantity of deposited toner on said test latent image, to provide a substantially constant test latent image cleaning load for varying developer station toner concentrations, and wherein said direct function change in the optical density of said reproduction output occurs with substantially no change in the magnitude of said reproduction development field.

9. An electrophotographic machine for producing reproductions, comprising:

photoconductor means relatively movable with respect to a plurality of reproduction process stations including developer station means;

said developer station means including a supply of toner and means for selectively providing a reproduction development vector or a patch development vector between said developer station means and said photoconductor means;

periodically operating patch sensing toner concentration control means operable to control the quantity of toner in said developer station so as to cause the concentration of toner in said developing station to be substantially equal to a defined concentration of toner;

control means operable to institute use of said patch development vector during said periodic operation of said patch sensing means; and optical density control means operable to change said defined concentration of toner, and to thereby change the optical density of reproduction output that is produced using said reproduction development vector;

said optical density control means operating to change the magnitude of said patch development vector in an inverse relation to the desired change in optical density.

10. The electrophotographic machine of claim 9 wherein said photoconductor is reusable, including a cleaning station operable to clean said photoconductor of residual toner after formation of reproductions, and to clean said photoconductor after operation of said toner concentration control means, wherein said inverse change in the magnitude of said patch development vector produces a substantially equal quantity of toner on said photoconductor for different reproduction optical densities, to thereby provide a substantially constant cleaning load for said cleaning station.

* * * * *